US005861791A

United States Patent [19]

Schneider

[11] Patent Number: 5,861,791

[45] Date of Patent: Jan. 19, 1999

[54] IGNITION COIL WITH NON-FILTERING/ NON-SEGREGATING SECONDARY WINDING SEPARATORS

[75] Inventor: Charles R. Schneider, Oshkosh, Wis.

[73] Assignee: Brunswick Corporation, Lake Forest, Ill.

[21] Appl. No.: 492,784

[22] Filed: Jun. 21, 1995

[51] Int. Cl.[6] ..... H01F 27/30; H01F 27/24

[52] U.S. Cl. ..... 336/205; 336/206; 336/209; 336/213; 336/219

[58] Field of Search ..... 123/599; 336/219, 336/213, 209, 205, 206

[56] References Cited

U.S. PATENT DOCUMENTS

| | | | |
|---|---|---|---|
| 3,273,099 | 9/1966 | Minks | 336/83 |
| 3,302,130 | 1/1967 | Minks | 331/112 |
| 3,448,423 | 6/1969 | Minks | 336/96 |
| 3,542,007 | 11/1970 | Minks | 123/148 |
| 3,549,944 | 12/1970 | Minks | 315/209 |
| 3,556,069 | 1/1971 | Minks | 123/143 |
| 3,566,188 | 2/1971 | Minks | 315/209 |
| 3,612,948 | 10/1971 | Minks | 315/209 |
| 3,675,077 | 7/1972 | Minks | 315/209 |
| 4,325,350 | 4/1982 | Bauer et al. | 123/605 |
| 4,433,668 | 2/1984 | Fitzner | 123/597 |
| 4,463,743 | 8/1984 | Fitzner | 123/599 |
| 4,496,926 | 1/1985 | Kubo et al. | 336/205 |
| 4,894,602 | 1/1990 | Davis et al. | 322/38 |
| 5,146,905 | 9/1992 | Davis | 123/599 |
| 5,396,210 | 3/1995 | Purohit et al. | 336/60 |
| 5,416,905 | 5/1995 | Mori et al. . | |

FOREIGN PATENT DOCUMENTS

| | | |
|---|---|---|
| 0031572 | 12/1980 | European Pat. Off. . |
| 031576 | 7/1983 | European Pat. Off. . |
| 1558855 | 2/1969 | France . |
| 3048803 | 10/1981 | Germany . |
| 474136 | 6/1969 | Switzerland . |
| 606186 | 8/1945 | United Kingdom . |
| 2013040 | 8/1979 | United Kingdom . |

*Primary Examiner*—Michael L. Gellner
*Assistant Examiner*—Daniel Chapik
*Attorney, Agent, or Firm*—Andrus, Sceales, Starke & Sawall

[57] ABSTRACT

An ignition coil for an internal combustion engine and a method of making the same in which layers of the secondary winding are separated by a non-filtering/non-segregating material embedded in an electrically insulated ignition coil housing. The preferred non-filtering secondary winding separator is a solid filament, non-absorbing/non-adsorbing mesh, such as a nylon mesh. Using the non-filtering/non-segregating secondary winding separator prevents filler damming when an ignition coil housing is manufactured using a vacuum encapsulation and curing process in which an encapsulation compound (e.g. a thermal setting epoxy) has solid additives (e.g. sand fillers). Non-absorbing/non-adsorbing separators are also advantageous because the separators do not alter the chemistry of the encapsulation compound.

17 Claims, 4 Drawing Sheets

IGNITION COIL WITH NON-FILTERING/ NON-SEGREGATING SECONDARY WINDING SEPARATORS

FIELD OF THE INVENTION

The invention relates to ignition coils for internal combustion engines and methods of making same.

BACKGROUND AND SUMMARY OF THE INVENTION

The invention arose during continuing development efforts relating to ignition systems for marine engines in which ignition energy is discharged across a spark plug to provide enough spark to ignite a combustible mixture in a cylinder. The invention arose particularly in connection with efforts to improve production quality and operating life of paper wound ignition coils encapsulated in an electrically insulated housing made from a thermal setting polymer compound.

Paper wound ignition coils typically have a primary winding and a secondary winding impregnated in an electrically insulated (dielectric) housing made from an encapsulation compound which usually have solid additives such as sand fillers. Historically, strips of electrical grade paper such as kraft paper have been used to separate layers of wire windings in the primary and secondary windings. Investigation has found that the paper separators in the secondary winding tend to filter the sand fillers or other solid additives during the manufacturing process, thus creating filler dams in the housing and producing variations in encapsulating polymer composition. The variations in polymer composition result in dielectric constant discontinuities throughout the housing. Perhaps more importantly, these composition discontinuities result in a non-uniform shrink rate when curing the housing material during the manufacturing process and in non-uniform thermal expansion characteristics of the manufactured housing. These discrepancies in shrink rate and in the coefficient of thermal expansion cause the housing to crack or otherwise deteriorate, both during manufacturing and thereafter, thereby potentially reducing coil voltage output or, in the worst case, causing coil failure. Test observations also indicate that the absorption and/or adsorption characteristics of the paper wire separators alter the chemistry of the encapsulation compound within the winding, resulting in additional dielectric discontinuities.

The invention provides an ignition coil and a method of making the same which uses non-filtering/non-segregating secondary winding wire separators in lieu of paper separators. The preferred secondary winding separators are strips of nylon (solid filament) mesh having a mesh size of roughly 0.050 inches. Other types of non-filtering/non-segregating separators such as closed cell, non-segregating polyester cloth are also considered to be within the scope of the invention. Using a non-filtering secondary winding separator alleviates the problem of filler damming and renders the composition of the housing essentially homogeneous throughout the housing. Because the composition of the housing is essentially homogeneous, the dielectric, shrink rate and thermal expansion characteristics are generally the same throughout the housing, and many of the above-described problems are alleviated.

Another advantage of nylon, or other materials made of solid filaments, is that the nylon separator does not alter the chemistry of the encapsulation compound by absorption and/or adsorption.

DETAILED DESCRIPTION OF THE DRAWINGS

Prior Art

Figure 1:
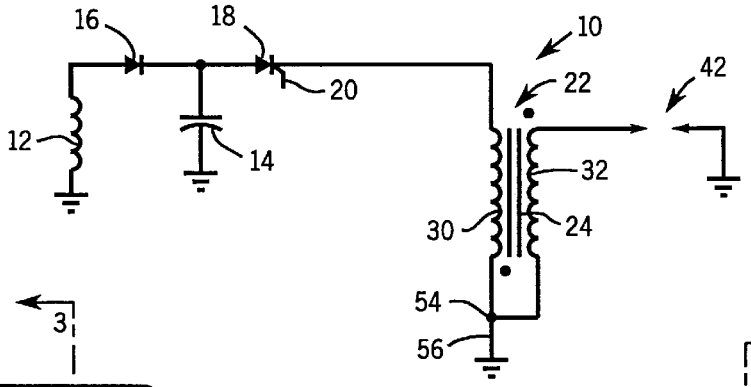
FIG. 1 (PRIOR ART)
FIG. 1 is a circuit diagram showing a typical capacitor discharging ignition system for a combustion engine.
Figure 2:
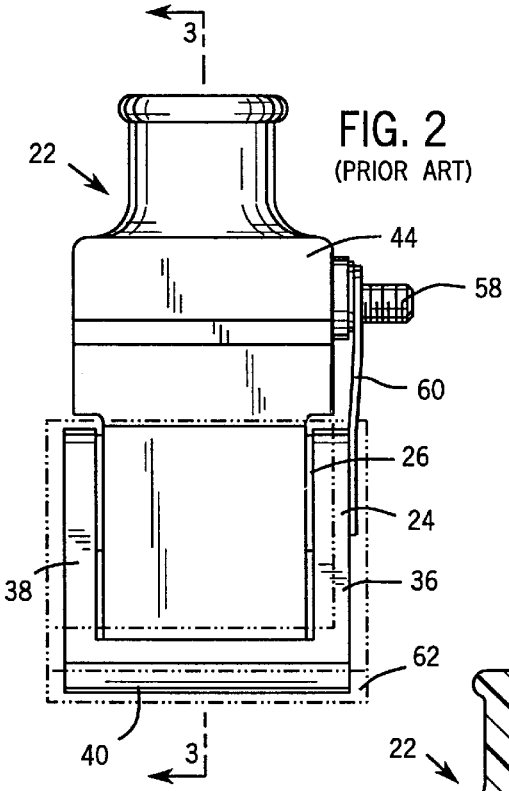
FIG. 2 (PRIOR ART)
FIG. 2 is a side elevational view of a paper wound ignition coil typically used in combustion engine ignition systems.

FIG. 1 shows a capacitor discharge ignition system 10 for an internal combustion engine, including an alternator stator coil 12 energized by rotation of the engine to develop voltage, a capacitor 14 charged through diode 16 by voltage from stator coil 12, and a semiconductor switch 18 for discharging capacitor 14 in response to a trigger signal at 20, as is standard in the art, and for which further reference may be had to U.S. Pat. Nos. 3,273,099; 3,302,130; 3,448,423; 3,542,007; 3,549,944; 3,556,069; 3,566,188; 3,612,948; 3,675,077; 5,146,905, incorporated herein by reference. Diode 16 prevents discharge of capacitor 14 back through alternator stator coil 12 when the coil 12 is not developing a positive voltage.

Ignition coil 22 has a magnetically permeable ferrite core 24, FIGS. 1, 2, 3, and 4. The core 24 has an axially extending core bar 26 which extends along axis 28, a primary winding 30 wound around core bar 26 and energized by discharge of capacitor 14 through semiconductor switch 18, and a secondary winding 32. Core 24 includes a magnetic flux return path outer yoke structure provided by a pair of arms 36 and 38, FIG. 4, at the axial ends of core bar 26 and extending radially therefrom and joined by yoke bar 40. Spark plug 42, FIG. 1, is energized by secondary winding 32.

The primary winding 30 and the secondary winding 32 are coaxial and are embedded in a cast molded housing 44 made by molding an electrically insulated polymer encapsulation compound, such as an epoxy. An electrically conductive female terminal cup or high tension tower 46 is aligned with secondary winding 32 and is connected thereto with embedded wire 48. Shrink tubing 49 is used to allow pin removal after cast molding. Terminal post 50 is connected to primary winding 30 by embedded wire 52. The negative or grounded end of the primary winding 30 is connected to the negative or grounded end of the secondary winding 32, shown schematically in FIG. 1 at node 54. An embedded ground wire 56 connects node 54 to a negative terminal post 58, FIG. 2. A ground tab 60 electrically connects the negative terminal post 58 to the core 24.

The core 24 is a two piece member 24*a* and 24*b* as in the prior art. Core piece 24*a* has core bar 26*a*, end arm 38, and a connecting yoke 40*a*. Core piece 24*b* has core bar 26*b*, end arm 36, and a connecting yoke 40*b*. After molding, the core pieces 24*a* and 24*b* are slid into the coil 22, one from each opposite axial end, and are cemented in place to the epoxy housing 44. The magnetic flux path is from core bar 26*a* to core bar 26*b* to arm 36 to connecting yoke 40*b* to connecting yoke 40*a* to arm 38 and back to core bar 26*a*. The assembled core is covered with an electrically insulating jacket 62, FIG. 2, preferably made of rubber.

Figure 3:
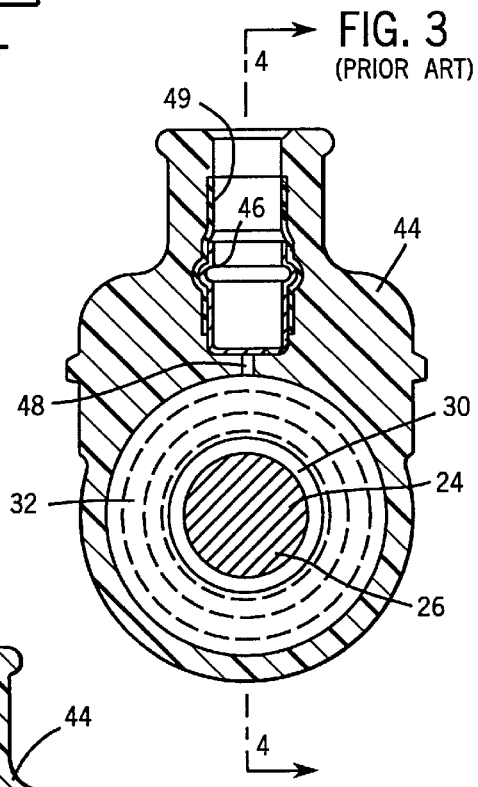
FIG. 3 (PRIOR ART)
FIG. 3 is a sectional view taken along lines 3—3 in FIG. 2.
Figure 4:
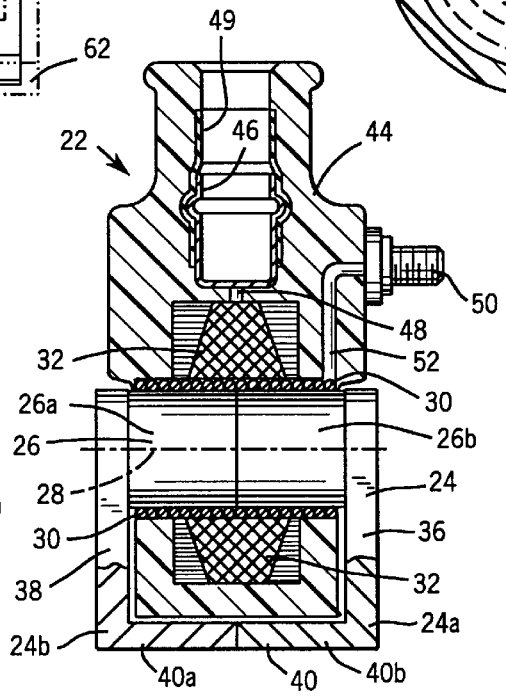
FIG. 4 (PRIOR ART)
FIG. 4 is a sectional view taken along lines 4—4 in FIG. 3.
Figure 5A:
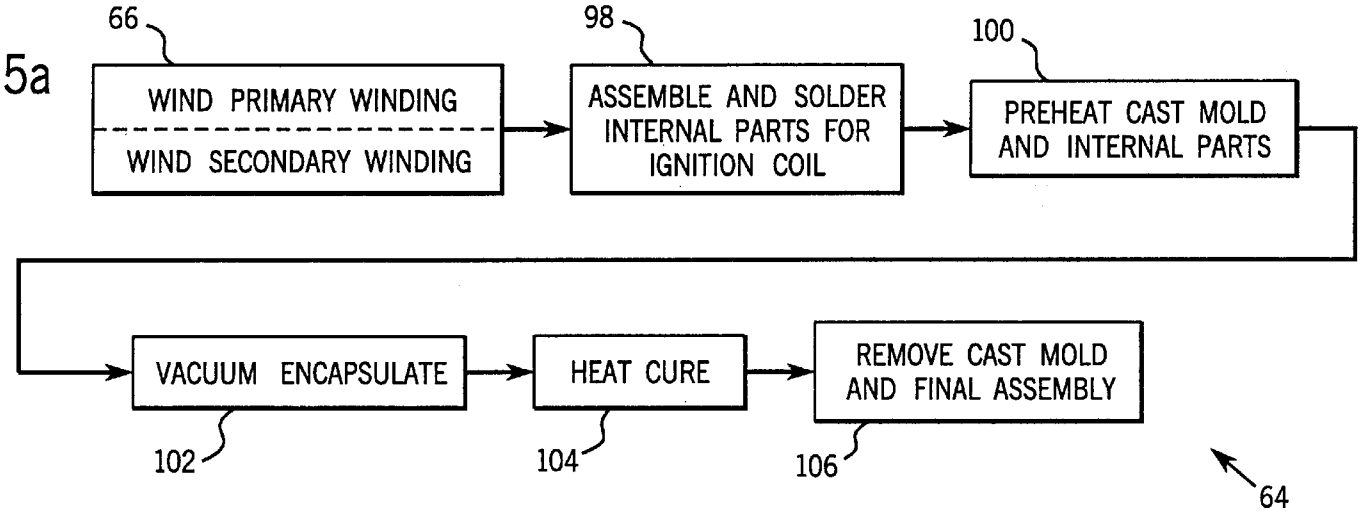
FIG. 5*a* is a schematic drawing illustrating a manufacturing process for paper wound ignition coils.

FIG. 5*a* is a flow diagram describing a typical manufacturing process 64 for ignition coils such as ignition coil 22, shown in FIGS. 1–4. The first step of the process depicted by block 66 includes winding the primary winding 30 and winding the secondary winding 32. The primary winding consists of 19 gauge insulated copper wire wound around a cardboard mandril 31 (FIG. 6*a*) having a 0.625 inch outside diameter. The primary winding should consist of approximately 13 turns. The primary winding 30 is typically secured to the mandril 31 with tape.

Figure 5B:
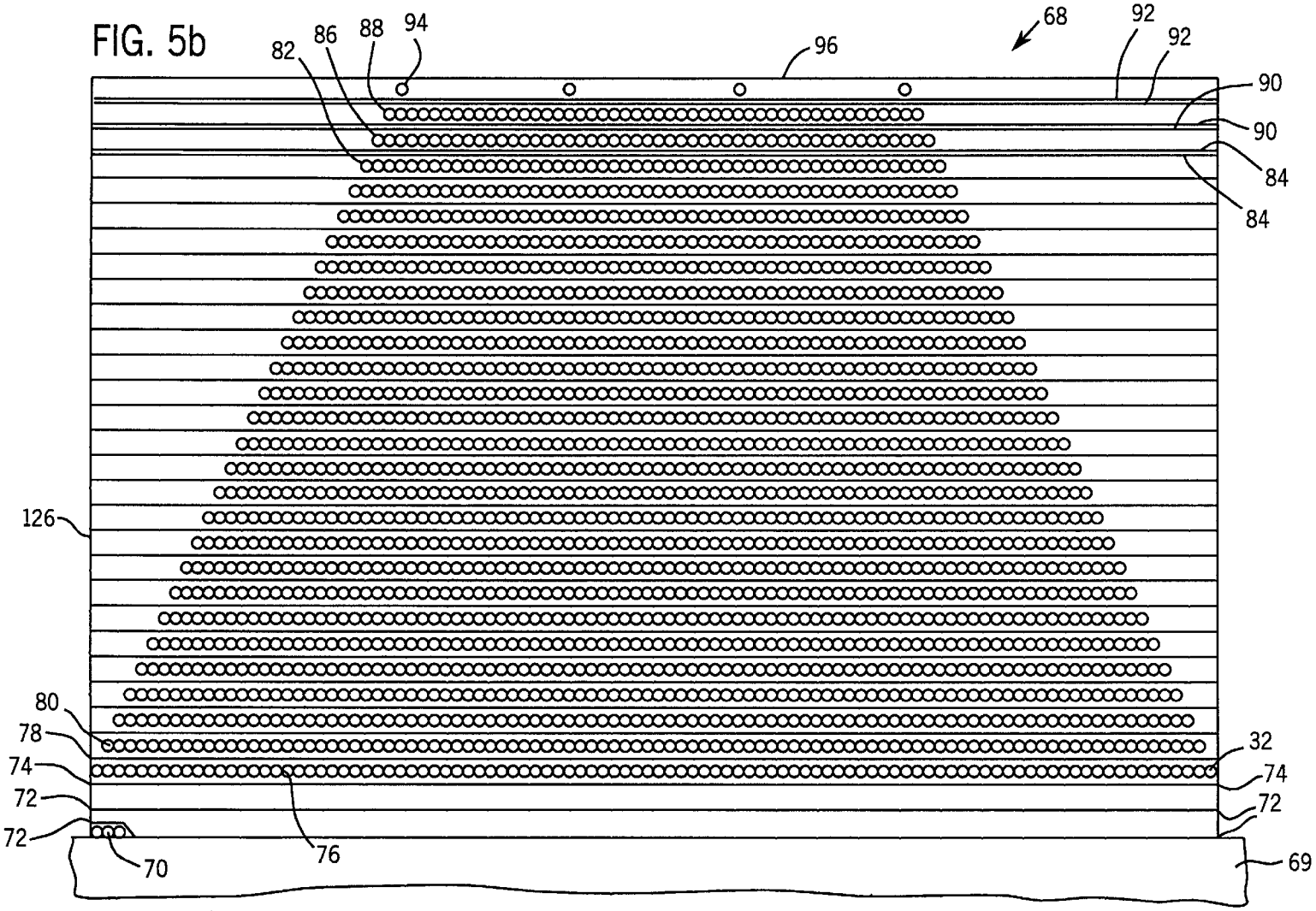
FIG. 5*b* is a schematic view of secondary windings in a paper wound ignition coil showing the layers of secondary windings being separated by strips of paper.

FIG. 5*b* is a schematic drawing illustrating a typical procedure 68 for winding a trapezoidal secondary winding 32. The secondary winding 32 is typically made by winding an insulated 42 gauge copper wire around a cardboard mandril 69 having a 0.781 inch outside diameter. The thickness of 42 gauge wire normally used for the secondary winding 32 is 0.0025 inches for the conductor, and 0.0035 inches including the insulation. To wind the secondary winding 32, three turns 70 of the 42 gauge wire are wound around the mandril 69. A strip of electrical grade kraft paper 72 four inches wide is wound around the mandril 69 and the first three turns 70. The kraft paper 72 is typically 0.005 inches thick. Another strip of paper 74, an electrical grade insulating paper having a thickness of 0.005 inches and a width of 3.25 inches, is then wound around the mandril 69 and the kraft paper sheet 72. Then 100 turns of the 42 gauge wire 76 are wound around the strip of insulating paper 74 in the space of about 0.44 inches to create the first layer 76 of the secondary winding 32. Another layer of insulating paper 78 is inserted around the first layer of wire 76. A second layer of wire 80 having 98 turns is wound around the insulating paper separator 78. The secondary winding procedure continues in this manner with each layer of windings being separated by an insulated paper separator. The 25th layer of the secondary winding 82 has 52 turns. Two layers of insulating paper 84 separate the 25th layer of wire 82 from the 26th layer of wire 86. The 26th layer of wire has 50 turns. Likewise, the 27th layer of wire 88 is separated from the 26th layer 86 with two layers of insulating paper 90. Two more layers of paper 92 are wrapped around the 27th layer 88 and a layer of surge windings 94 having four turns is wrapped around the paper sheets 92. The surge windings 94 increase the magnetic flux of the trapezoidal secondary coil. The trapezoidal secondary winding is then wrapped with a protective layer of kraft paper 96. Electrical grade tape secures the outer paper layer 96 around the secondary coil 32.

Referring again to FIG. 5*a*, the primary winding and the secondary winding along with other internal parts for the ignition coil are assembled and soldered together, block 98. In particular, the primary coil 30 and the secondary coil 32 are arranged in an axial configuration, FIGS. 3 and 4, and the terminal posts 50, 58 and the female terminal cup 46 are soldered or otherwise attached to the ends of the windings as shown in FIGS. 3 and 4. The assembled internal parts for the ignition coil 22 are then placed in a metal cast mold.

The metal cast mold and the internal parts are preheated in an oven, block 100. Preheating 100 is usually at about 220°–225° F. for a period of about two hours. The main purposes of preheating are to remove excess moisture and other contaminants from the mold and the internal parts, and to raise the temperature of the mold and the internal parts for vacuum encapsulation, block 102.

The step of vacuum encapsulation 102 involves the mixing of part A and part B of a thermal setting compound and pouring the mixed thermal setting compound into the cast mold under vacuum conditions. The preferred casting or encapsulation compound (i.e. the mixed thermal setting compound) is an epoxy such as an anhydride. Anhydrides have sufficient dielectric strength to meet the requirements of the secondary winding 32. The encapsulation compound normally includes sand fillers such as alumina-oxide, talc or silica, or sometimes includes clay fillers. The mixed encapsulation compound is poured into the cast mold at a temperature of 180° F. to 190° F. and a pressure of 0.5 Torr (i.e. very close to a complete vacuum). To allow volatiles to escape, the cast mold and the internal components are exposed to the 0.5 Torr vacuum environment for about one minute before pouring in the mixed encapsulation compound.

Other types of thermal setting encapsulation compounds besides epoxies have been used in the art such as urethanes or polybutadienes.

The cast mold filled with the liquid encapsulation compound is heat cured to increase the cross link density and solidify the encapsulation compound. It is normally preferred that heat curing be accomplished between 220° F. and 250° F. oven temperature, which does not include exothermic energy from the cure process. The curing process normally takes about two hours. During the heat curing step, block 104, the encapsulation compound shrinks. Therefore, it is normally important, depending upon the encapsulation compound, to design the cast mold so the housing 44 does not fracture upon curing. After heat curing 104, the cast mold is cooled and then removed from the molded housing 44, block 106. Final assembly such as removing excess parts of the molded housing 44 needed for the molding process, and assembling core 24, ground tab 60 and insulating jacket 62 to the coil are then carried out.

Figure 6A:
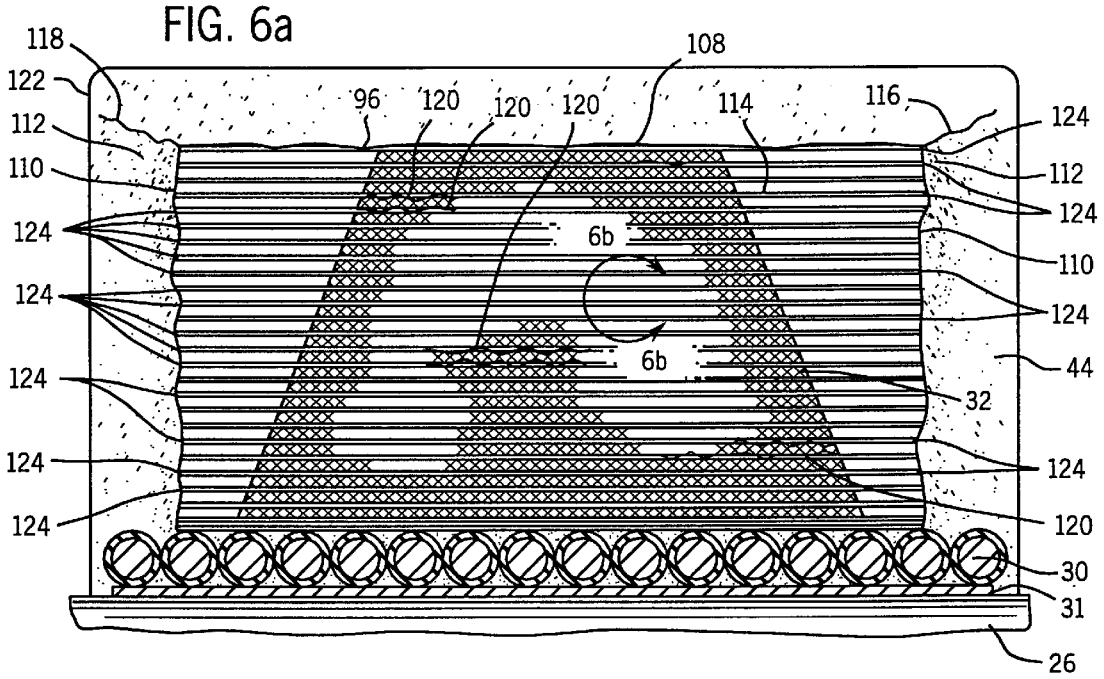
FIG. 6*a* is a schematic drawing of cross-section of a paper wound ignition coil showing typical types of fractures in the coil housing.

FIG. 6*a* illustrates various types of potential failures associated with paper wound ignition coils 22 manufactured by the above-described process. One type of failure is a horizontal crack 108 along the top edge of the paper 96. The reason for this type of failure 108 is that the top layer of paper 96, which is typically a protective paper (e.g. oil or onion skin paper), does not absorb the encapsulation compound and does not facilitate effective binding of the encapsulation compound to the top layer of paper 96.

The darkened areas 112 represent filler dams (i.e. volumes of high filler content). The filler dams 112 occur because paper is cellular and the filler sand cannot penetrate past the closely laid layers of paper in the secondary winding 32. Filler damming does not occur along the top layer 96 of paper because the encapsulation compound does not penetrate through the layer 96 to any appreciable extent. Filler damming in areas 112 can be significant. By way of example, an encapsulation compound having 50% filler by weight would likely have 75% filler in the filler dam areas 112 and little or no filler within the layers of paper 114 in the secondary winding 32.

Filler damming can present problems because of the variation in composition. The filler dams 112 shrink less than the rest of the housing 44 during cool down after heat curing. For example, a typical shrink rate for the encapsulation compound having 50% filler from the peak exothermic cure temperature to an ambient temperature of 72° would typically be 0.0153 shrink inches per inch of material. In the area of the filler dam 112 having 75% filler, the shrink rate would typically be 0.010 shrink inches per inch under the same conditions. For the pure or nearly pure polymer 114 located within the layers of paper in the secondary winding 32, a typical shrink rate would be 0.023 shrink inches per inch.

Reference number 110 indicates vertical reflow cracks along the edge of the secondary winding 32, which form during heat curing and are refilled before curing is complete. During the curing process, the discrepancies in the shrink rates causes the vertical reflow cracks 110 (which are typically refilled with pure polymer) and also other cracks such as crack 116 angling upward from the corner of the filler dam 112 towards the edge of the housing 44. Sometimes a crack like crack 116 propagates completely to the edge of the housing 44 during cool down such as depicted by crack 118.

Also typical during the heat curing process are cracks 120 occurring throughout the secondary winding 32 usually between layers of the secondary winding. The cracks or fractures 120 provide dielectric discontinuities that disrupt the magnetic field density lines and result in reduced output voltage which in turn can diminish engine performance. In operation over time, the encapsulation compound in the area of the dielectric discontinuities 120 will typically be broken down further due to corona discharge. Eventually, the breakdown around the dielectric discontinuities will be exacerbated to such an extent that arcing occurs between the windings. As this type of deterioration 120 increases, the output voltage from the secondary winding 32 to the spark plug 42 will continually decrease. At some point, the voltage output from the coil 22 may decrease to such an extent that the coil 22 can no longer fire a spark plug 42 (e.g. about 13 kilovolts).

Although cracking such as 108, 110, 116, 118 and 120 can occur during the heat curing process, cracking can begin or grow further after the coil is cured due to thermal cycling and variations in thermal expansion characteristics throughout the housing 44. One type of failure that can happen due to thermal cycling is a burn hole 122. A burn hole 122 occurs where a path opens between the secondary winding 32 and the ferrite arms 36 or 38 or yokes 40. If there is an open path to the grounded ferrite, the high voltage in the secondary winding 32 may choose the open path as the path of least resistance instead of the path across spark plug 42. An example of such an open path is illustrated along crack 108, to crack 118, and completely to the edge of the housing 44 to burn hole 122.

Figure 6B:
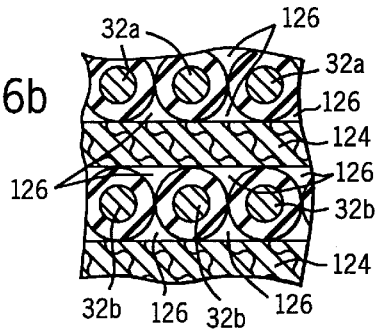
FIG. 6*b* is a detailed drawing of the area in FIG. 6*a* designated by lines 6*b*—6*b;*

Referring to FIG. 6*b*, layers of secondary windings 32*a* and 32*b* are separated by paper 124 which are normally saturated with the encapsulation polymer, but this is not always the case. Encapsulation polymer also resides in the spaces 126 between the windings 32*a* and 32*b* and the paper 124. If the encapsulation compound does not sufficiently saturate the paper 124, the dielectric constant across the paper 124 between layers of windings 32*a* and 32*b* may not be sufficient, thereby promoting corona breakdown and arcing. In addition, when the encapsulation polymer absorbs and/or adsorbs into the paper 124, the chemistry of the encapsulation polymer in the vicinity of the paper 124 changes. The chemistry changes promote the creation of cracks in the secondary winding 32 such as cracks 120. That is, cracks 120 will still occur if there are no solid additives in the encapsulation compound.

Present Invention

Figure 8:
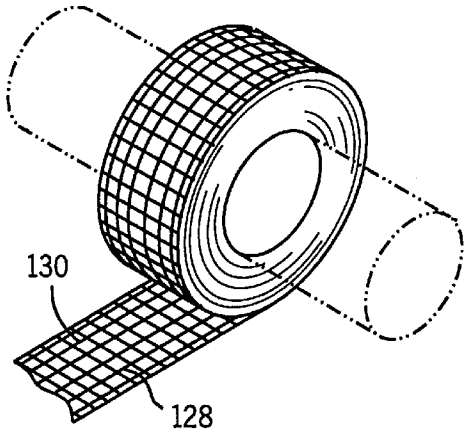
FIG. 8 is a schematic view of a manufacturing step of winding a secondary winding with nylon mesh.
Figure 7B:
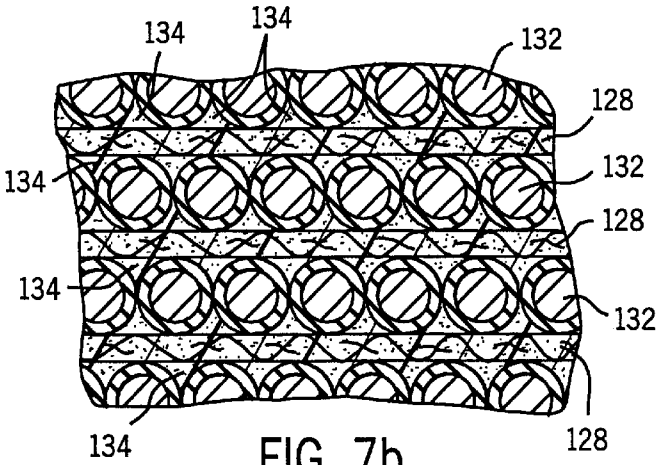
FIG. 7*b* is a detailed view of the area depicted by line 7*b*—7*b* and FIG. 7*a;*
Figure 7A:
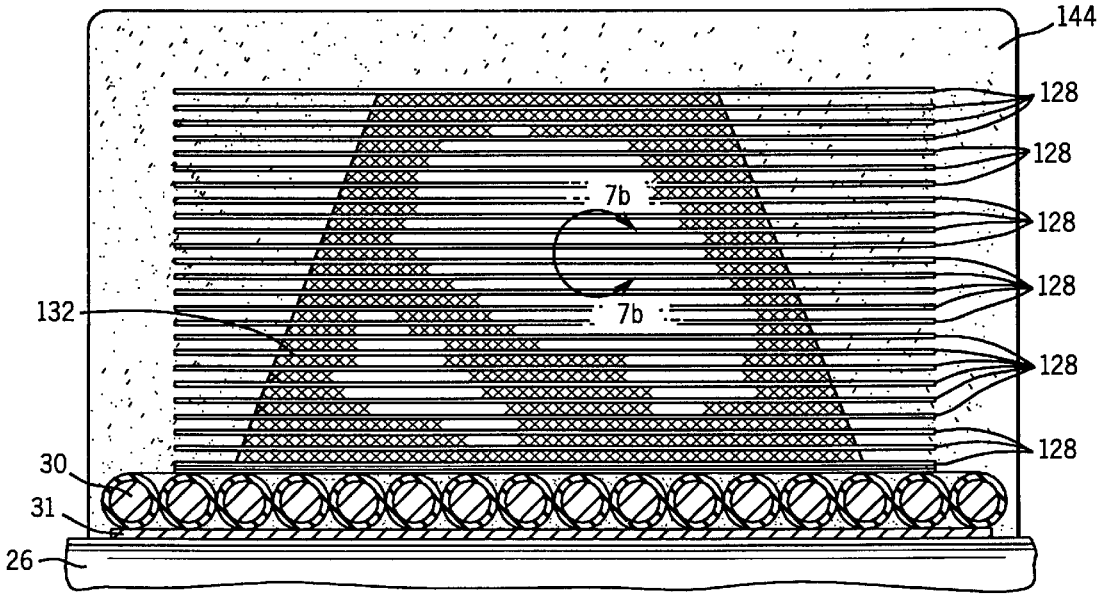
FIG. 7*a* is a schematic drawing of a coil cross-section of an ignition coil having solid filament nylon mesh secondary winding separators as in accordance with the invention.

The invention eliminates the cracks and deterioration depicted in FIG. 6*a* which result from filler dams 112 and the related variation in composition throughout the housing 44. Referring to FIGS. 7*a*, 7*b* and 8, the invention does this by replacing the layers of paper 124 that separate the layers of wire in the secondary winding 32 with solid filament nylon mesh 128 or some other non-filtering/non-segregating secondary winding separator. The preferred nylon mesh 128 has generally square mesh openings 0.008 inches thick, and has a mesh opening size of about 0.005 inches. Such a mesh size is large enough to allow particulates of filler to flow essentially unobstructed throughout the housing 144 during the vacuum encapsulation step, block 102 in FIG. 5*a*, of the manufacturing process. In order to ensure that filler damming does not occur, the size of the openings in the mesh should be greater than the largest size of filler used for that particular molding process. Since the mesh 128 does not filter filler material in the encapsulation compound, there is little or no filler damming and the composition of the housing 144 is likely to be homogeneous throughout the housing 144. Because the composition of the housing 144 is likely to be homogeneous throughout, the likelihood of fractures due to variations in shrink rate during the heat curing process, or due to variations in thermal expansion characteristics during thermal cycling is greatly reduced.

The invention can be carried out in an ignition coil 22 manufactured using the same or similar techniques as described in FIGS. 5*a* and 5*b*, except replacing the paper separating layers 126 and/or the paper protective layers 72, 74 and 96 with solid filament nylon mesh 128. FIG. 8 shows the preferred method of applying the nylon mesh 128 having a square mesh pattern in which longitudinal strands 130 of the mesh 128 are lined up generally parallel with the secondary windings. The configuration shown in FIG. 8 is preferred because this configuration helps keep the secondary windings aligned.

The nylon mesh 128 is also a solid filament which does not absorb or adsorb any components of the encapsulation compound, and therefore does not alter the chemistry of the encapsulation compound in the vicinity of the paper 124. In addition, the polymer encapsulation compound tends to bind easily to the nylon mesh 128.

Another advantage of using the nylon mesh is depicted in FIG. 7*b*, where it can be seen that the encapsulation compound not only fills spaces 134 between the secondary windings 132 and the nylon mesh 128 but also fills through the mesh between different layers 132 of the secondary winding. This reduces the likelihood of dielectric discontinuities between the layers 132 of the secondary winding. Using the nylon mesh 128 also reduces cracks such as crack 108, FIG. 6*a*, at the top paper layer 96 because the encapsulation compound is allowed to fully flow through the top layer before curing, and there is no requirement that the encapsulation compound bind to the outer protective layer.

While it is preferred to carry out the invention with nylon mesh, the invention may be carried out with other types of non-filtering/non-segregating separators. One other type of non-filtering separator that may be desirable is non-segregating polyester cloth. Polyester cloth is not hydroscopic, so polyester cloth will not give up water during vacuum encapsulation, block 102 in FIG. 5*a*, which can compromise the integrity of the housing 144.

Electrical tape has typically been used in the prior art to secure both the primary winding 30 and the secondary winding 32 during manufacture before the ignition coil housing 44 is completely cured. In carrying out the invention, it is desirable to reduce the amount of tape and lessen the amount of adhesives or tackifiers in the manufactured housing 144. It is also desirable that the tape either be non-filtering or that the encapsulation compound easily bind to the tape. It is also desirable that the tape does not effect the chemistry of the adjacent encapsulation compound.

It should be recognized that various equivalents, alternatives and modifications are possible within the scope of the intended claims. For instance, while the invention has been described with respect to a cast molding manufacturing process, the invention is also useful for potted ignition coils (i.e. ignition coils in which the encapsulation compound is poured into a shell which is not removed after manufacture) or other impregnating techniques. With potted ignition coils, softer encapsulation compounds such as silicone can reduce the growth of fractures due to thermal cycling, and therefore may be desirable.

It is not a requirement of the invention that the encapsulation compound be a thermal setting mixture in which heat curing is required. For instance, the invention applies to encapsulation compounds which can cure at room temperature. Also, in some applications additives other than fillers are used in the encapsulation compound. These other types of additives can include binders such as shredded fiberglass, and the invention can be applied to these types of additives as well.

While the invention has been described in conjunction with an ignition coil for an internal combustion engine, the invention is not limited to combustion engine ignition coils. For instance, the invention can be employed in ignition coils that ignite combustible fuel mixtures in environments other than internal combustion engines, such as stoves, ovens or furnaces.

I claim:

1. An ignition coil for an internal combustion engine comprising:

a magnetically permeable core having an axially extending core bar;

a primary winding wound around the core bar and having an input terminal for inputting electrical energy from a voltage source;

a secondary winding having a plurality of layers of wire continuously wound around the core bar and having an output terminal for outputting high voltage electrical energy to ignite a combustible fuel mixture in an internal combustion engine, said secondary winding including a plurality of secondary winding separator strips embedded between adjacent layers of the secondary winding, each of the secondary winding separator strips being made from a flexible non-filtering, non-segregating material wherein each respective layer of the secondary winding is separated from adjacent layers in the secondary winding by at least one layer of the non-filtering, non-segregating secondary winding separator strip material;

an electrically insulated housing made from an encapsulation compound having solid additives;

wherein the primary winding is coaxial with the secondary winding and both the primary winding and the secondary winding are impregnated in the electrically insulated housing and the secondary winding separator strip material includes a plurality of openings therethrough which are large enough to avoid substantial interference of the flow of solid additives in the encapsulation compound through the secondary winding during the manufacturing process.

2. An ignition coil as recited in claim 1 wherein the secondary winding separator strips are strips of solid filament nylon mesh embedded in the housing between the adjacent layers of the secondary winding.

3. An ignition coil as recited in claim 2 wherein the embedded nylon mesh has a mesh size of roughly 0.050 inches.

4. An ignition coil as recited in claim 2 wherein the nylon mesh has longitudinal strands and transverse strands and the longitudinal strands are generally parallel to wires in the secondary winding.

5. An ignition coil as recited in claim 1 wherein an outermost layer in the secondary winding is covered by an outer layer of non-filtering, non-segregating material embedded in the housing.

6. An ignition coil as recited in claim 5 wherein the outer layer of the non-filtering, non-segregating material covering the outer layer of the secondary winding is a strip of nylon mesh embedded in the housing.

7. An ignition coil as recited in claim 1 wherein the solid additives are sand fillers.

8. An ignition coil as recited in claim 1 wherein the encapsulation compound is a thermal setting epoxy.

9. An ignition coil for an internal combustion engine comprising:

a magnetically permeable core having an axially extending core bar;

an electrically insulated housing made from an encapsulation compound;

a primary winding wound around the core bar and having an input terminal for inputting electrical energy from a voltage source;

a secondary winding having a plurality of layers of wire continuously wound around the core bar and having an output terminal for outputting high voltage electrical energy to ignite a combustible fuel mixture in an internal combustion engine, said secondary winding including a plurality of secondary winding separator strips embedded between adjacent layers of the secondary winding, each of the secondary winding separator strips being made of a material that does not absorb or adsorb the encapsulation compound, wherein each respective layer of secondary winding is separated by at least one layer of the secondary winding separator strip material;

wherein the primary winding is coaxial with the secondary winding and both the primary winding and the secondary winding are impregnated in the electrically insulated housing and the secondary winding separator strip material does not alter the chemistry of the encapsulation compound within the secondary winding during the manufacturing process.

10. An ignition coil as recited in claim 9 wherein the secondary winding separator is made from a material of solid filaments.

11. An ignition coil as recited in claim 9 wherein the secondary winding separator is made of nylon.

12. A method of making an ignition coil comprising the steps of:

winding a primary winding;

winding a secondary winding to provide a continuous winding of a plurality of layers of insulated wire, wherein each respective layer of the secondary winding is separated from the adjacent layers in the secondary winding by a secondary winding separator strip that is embedded between adjacent layers of wire when winding the secondary winding, each of the secondary winding separator strips being made from a flexible non-filtering, non-segregating material;

assembling internal parts for the ignition coil including the primary winding and the secondary winding;

placing the assembled internal parts of the ignition coil in a cast mold;

vacuum encapsulating the assembled internal parts in the cast mold by impregnating the parts with an encapsulation compound having solid additives; and curing the encapsulation compound to solidify a housing for the ignition coil.

13. A method of making an ignition coil as recited in claim 12 wherein the encapsulation compound is a thermal setting compound and the thermal setting compound is heat cured.

14. A method of making an ignition coil as recited in claim 13 wherein the thermal setting compound is an epoxy and the solid additives are sand fillers.

15. A method of making an ignition coil as recited in claim 12 further comprising the step of:

placing the assembled internal parts of the ignition coil in a cast mold; and preheating the cast mold and the internal parts before vacuum encapsulation.

16. A method of making an ignition coil as recited in claim 12 wherein a non-filtering, non-segregating outer strip of material is placed around the outer layer of the secondary winding before assembling the internal parts of the ignition coil.

17. A method of making an ignition coil comprising the steps of:

winding a primary winding;

winding a secondary winding to provide a continuous winding of a plurality of layers of insulated wire, wherein each respective layer of the secondary winding is separated from the adjacent layers in the secondary winding by a secondary winding separator strip that is embedded between adjacent layers of wire when winding the secondary winding, each of the secondary winding separator strips being made from a material that does not absorb or adsorb the encapsulation compound used to encapsulate the internal components of the ignition coil and that does not otherwise substantially alter the chemistry of the encapsulation compound when in contact therewith;

assembling internal parts for the ignition coil including the primary winding and the secondary winding;

placing the assembled internal parts of the ignition coil in a cast mold;

vacuum encapsulating the assembled internal parts in the cast mold by impregnating the parts with the encapsulation compound; and curing the encapsulation compound to solidify a housing for the ignition coil.

* * * * *